United States Patent [19]

Smith

[11] Patent Number: 4,542,700

[45] Date of Patent: Sep. 24, 1985

[54] THREE AXLE STEERED TRUCK

[75] Inventor: Roy E. Smith, Kingston, Canada

[73] Assignee: Urban Transportation Development Corporation Ltd., Toronto, Canada

[21] Appl. No.: 457,835

[22] Filed: Jan. 14, 1983

[30] Foreign Application Priority Data

Dec. 30, 1982 [CA] Canada ..... 418770

[51] Int. Cl.[4] ..... B61F 5/46

[52] U.S. Cl. ..... 105/166; 105/196

[58] Field of Search ..... 105/165, 166, 167, 168, 105/288, 182 R, 196

[56] References Cited

U.S. PATENT DOCUMENTS

| | | | |
|---|---|---|---|
| 118,515 | 8/1871 | Clark | 105/166 |
| 212,771 | 2/1879 | Vincent | 105/166 |
| 245,920 | 8/1881 | Fee | 105/166 |
| 513,835 | 1/1884 | Smithman | 105/166 |
| 1,728,096 | 9/1929 | Algrain | 105/166 |
| 4,164,188 | 8/1979 | Hallam et al. | 105/166 |
| 4,285,280 | 8/1981 | Smith | 105/168 |

FOREIGN PATENT DOCUMENTS

| | | | |
|---|---|---|---|
| 28103 | 8/1884 | Fed. Rep. of Germany | 105/166 |
| 50197 | 6/1911 | Fed. Rep. of Germany . | |
| 590867 | 12/1933 | Fed. Rep. of Germany . | |
| 1920596 | 11/1969 | Fed. Rep. of Germany | 105/166 |

*Primary Examiner*—David A. Scherbel
*Assistant Examiner*—Donald T. Hajec
*Attorney, Agent, or Firm*—Rogers, Bereskin & Parr

[57] ABSTRACT

A truck for use on a railway vehicle has three axles, one located at each end of the truck and a third located generally centrally between the other two axles. The two outboard axles are pivotable about respective vertical axes so as to be free to move to a radial alignment when the truck is travelling on curved track. The axle located generally centrally between the other two axles is free to move laterally but is constrained to eliminate movement about a substantially vertical axis. An interconnecting member is provided so that the lateral movement of the central axle is used to guide the outboard axles to the radial alignment.

3 Claims, 6 Drawing Figures

THREE AXLE STEERED TRUCK

This invention relates to railway car equipment and in particular, relates to a truck having three wheel sets all of which assume a radial position when the truck is travelling on curved railway track.

Typically, a railroad vehicle will comprise a pair of trucks at the vicinity of either end of the railway vehicle. The relatively short wheel base truck contains a plurality of axles or wheel sets. A wheel set comprises a pair of flanged wheels having conical surfaces that contact the guiding rails and a single axle. Each wheel is affixed to the axle such that the wheels and axle turn at the same angular speed at all times. With such a fixed wheel set the axle is self-aligning on the railroad track.

As will be familiar to those skilled in this art, a single wheel set having conical wheels will move to a radial alignment when travelling on curved track. Such a single wheel set, however, is not stable and the wheel set will "hunt" as the wheel set moves along either tangent track or curved track. In order to provide stability the common short wheel base truck having two or more such axles has often been used. In such a truck the two axles are mounted in bearing means to maintain the axles parallel to one another. Such a truck is then stable and will not "hunt" at speeds which are operationally desirable. Because the axles are held parallel, they cannot be radially aligned, with the result that the wheels must slip with respect to the rail generating objectionable noise and wear.

Various mechanisms have been provided in the prior art to permit the two axles of a two axle truck to move to a radial configuration as the vehicle travels on curved railway track.

One such example is Canadian Pat. No. 1,083,886 issued Aug. 19, 1980 to Urban Transportation Development Corporation Ltd. In that patent two axles of a short wheel base truck are mounted to frame means in bearings which permit the axles to rotate about a substantially horizontal axis. Each of the axles has at least one bearing means which is attached to a steering lever for pivotal movement between the bearing means and the steering lever. The steering levers in each case are mounted to the frame means of the truck for pivotal movement between the respective steering lever and the frame. The steering levers are also attached to steering rods. In the foregoing patent, the rotation of the truck relative to the car body when the car body is travelling on a curve results in movement of the steering rods. Movement of the steering rods in turn causes pivotal movement of the steering levers which in turn effects relative pivotal movement between each of the axles and the frame means thus providing the required steering motions. As the degree of rotation of the truck relative to the car body is a function of the radius of curvature of the track on which the car is travelling, it is a simple mechanical problem to ensure that the steering levers have the correct proportion so that the axles are moved to align properly with the curve, an amount proportional to the angle between the truck and the car body.

In certain circumstances there are advantages in using three axle trucks. The three axle truck may be manufactured in the same manner as a two axle truck, that is, providing bearing means which essentially maintain a parallel relationship between all three of the axles at all times. When such a truck is travelling on curved track the axles cannot all be in the radial configuration if the parallel relationship between the axles is maintained. As with the two axle truck, it is desirable to arrange to pivot the axles so that the axles will be radially aligned when the truck is travelling on curved track.

One such prior art patent which deals with radial alignment for three axle trucks is Imperial German Pat. No. 590,867 issued Dec. 21, 1933 to Waggonfabrik A.G. In that patent a hydraulic cylinder is operatively coupled to a central axle of a three axle truck. Movement of the centre axle transverse to the frame of the truck results in movement of oil into or out of the central cylinder attached to the central axle. Hydraulic cylinders filled with oil and attached to the other two axles and hydraulically linked to the cylinder connected to the centre axle result in movement of the other two axles.

The prior art devices have, however, failed to provide a simple mechanism which may be used in association with a three axle truck. When using a two axle truck the axles may be operatively linked to the body portion as illustrated in Canadian Pat. No. 1,083,886 to cause motion of the axles to assume the radial alignment. A different steering input may be used in the three axle truck.

In a three axle truck, the centre axle must be mounted so as to permit transverse movement relative to the frame if the truck is to be enabled to travel on curved track. The centre axle must also be restrained from pivoting relative to the truck frame. In German Pat. No. 590,867 a single hydraulic cylinder is attached to the centre axle and is responsive to this lateral movement. There appear to be several problems with the mechanism described in that patent. No structure is provided in that patent to ensure that the oil expelled from or drawn into the centre cylinder flows equally from or to the other two axles. Also, the German patent fails to recognize that instability of the outer axles causing them to deviate from the desired position can occur with the mechanism taught. In the German patent if the leading axle of the truck deviates from the desired position whether on tangent track or on curved track, the deviation is permitted by reason of the trailing axle moving an equal and opposite amount. This results from the direct interconnection of the leading and trailing axle through the central hydraulic cylinder. Such instability would render the truck totally objectionable in practice.

According to the present invention a mechanism is provided so that lateral movement of the third axle intermediate first and second axles causes pivotal movement of each of the first and second axles with respect to the truck. All of the axles are mounted in bearings for rotation about a horizontal axis. At least one of the bearings of each of the first and second axles are attached to steering levers which permit relative pivotal movement between the steering lever and the bearing. Each of these steering levers is attached to the frame of the truck to permit relative pivotal movement between the frame and the steering lever about a vertical axis which is not coincident with the axis of pivotal movement between the steering lever and its associated bearing. The third axle is mounted to the truck frame so as to permit lateral movement but to inhibit pivotal movement. An interconnecting linkage is provided. The interconnecting linkage is pivotally attached to the steering levers and the third axle and the lengths of the linkage are selected so that lateral movement of the third axle causes pivotal movement of the first and second axles moving these axles to a radial alignment. With this linkage the pivotal position of the first and second axles is at all times determined by the lateral position of the third axle.

The invention will now be described in association with two preferred embodiments of the invention illustrated by way of example in the appended drawings and in which.

Figure 1:
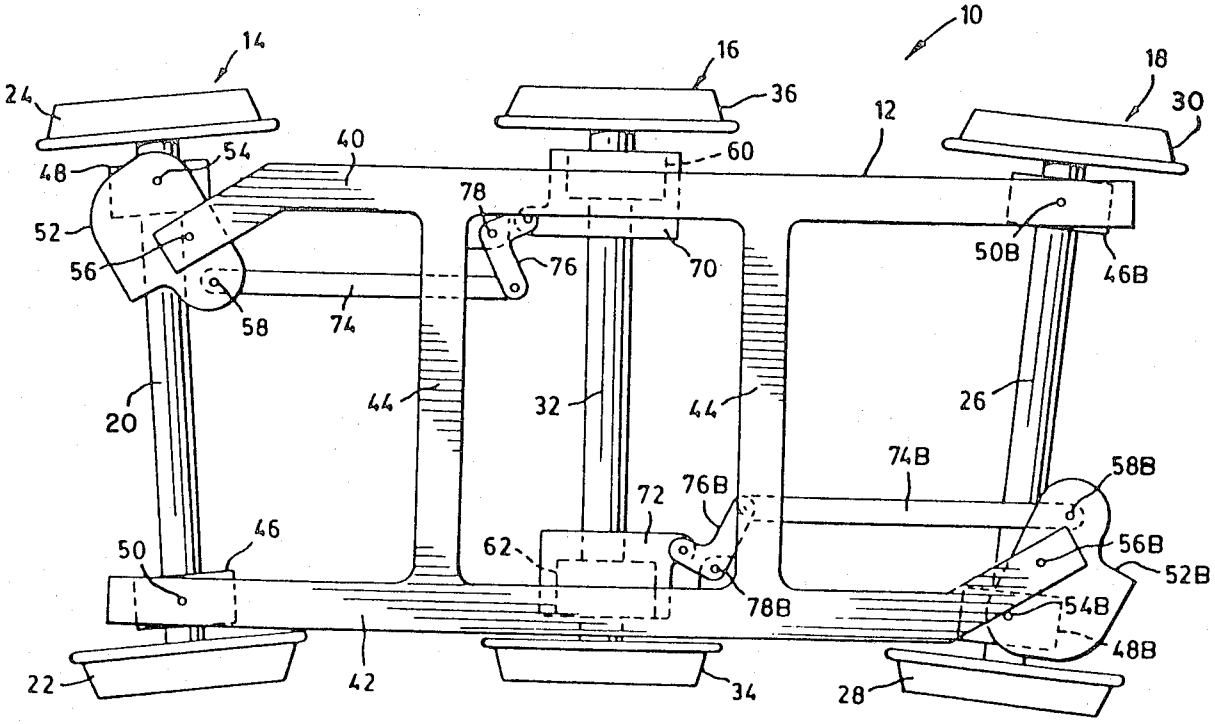
FIG. 1 is a schematic plan view of a truck utilizing a preferred embodiment of the invention.

FIG. 1 illustrates a truck illustrated generally at 10 having a frame 12 and three wheel sets 14, 16 and 18.

First wheel set 14 comprises an axle 20 and conical wheels 22 and 24. The second wheel set 18 comprises an axle 26 and two wheels 28 and 30. The third wheel set 16 located between wheel sets 14 and 18 comprises an axle 32 and wheels 34 and 36.

The frame 12 comprises two longitudinally extending side members 40 and 42 and a plurality of cross members 44. The frame is shown schematically as being a ladder type frame. However, any form of suitable frame may be used in conjunction with this invention.

The wheel set 14 is mounted in bearings 46 and 48 for rotation about a substantially horizontal axis. The bearing 46 is affixed to the frame 12 so as to be rotatable about a substantially vertical pivotal axis 50. The bearing 48 is affixed to a steering lever 52 so as to be rotatable about a substantially vertical pivotal axis 54. The steering lever 52 is affixed to the frame 12 for rotation about a substantially vertical pivotal axis 56.

The wheel set 18 is affixed to the frame 12 in a similar manner. The corresponding portions of the bearing and steering mechanism of the wheel set 18 are numbered as with wheel set 14 to which subscript B has been added. The steering mechanism has been reversed left for right to produce similar but opposite movement.

Wheel set 16 which is intermediate wheel sets 14 and 18 is supported in bearings 60 and 62 for rotation about a substantially horizontal axis. The bearings 60 and 62 prevent any pivotal motion of the wheel set 16 with respect to the frame 12 but permit lateral motion along the axis of the axle 32 with respect to the frame 12. As shown in FIG. 1 the wheel set 32 has been shifted with respect to the frame (wheel 34 is closer to frame 12 than wheel 36) thus illustrating the truck according to the invention when travelling on curved track.

Attached to the axle 32 of wheel set 16 are a pair of guide boxes 70 and 72 respectively. The guide boxes 70 and 72 move laterally with respect to the frame 12 by virtue of their connection to the wheel set 16 which moves laterally when the truck is travelling on curved track.

The guide box 70 is connected to the steering lever 52 by a steering rod 74 and a bell crank 76. The bell crank 76 is pivotally attached to the frame 12 about an axis designated 78. The bell crank 76 is also pivotally attached to the guide box 70 and the steering rod 74. Steering rod 74 is pivotally attached 58 to the steering lever 52. A certain resilience is required at the connection of bell crank 76 to guide box 70 in order to allow for the small relative longitudinal displacements which will take place as the mechanism is moved.

The guide box 72 is attached to the steering lever 52B by a similar bell crank 76B attached for pivotal movement with respect to the frame 12 about pivotal axis designated 78B. The bell crank 76B is pivotally attached 58B to the steering rod 74B which is in turn pivotally attached to the steering lever 52B.

As shown in FIG. 1 when the truck is travelling on curved track the wheel set 16 will be displaced with respect to the frame 12 outwardly away from the centre of curvature of the curve. Movement of the wheel set 16 towards the top of FIG. 1 causes rotation of bell crank 76 about pivotal axis 78 in the counterclockwise direction. This in turn causes counterclockwise rotation of the steering lever 52 about its pivotal axis 56 thereby causing relative pivotal movement of the wheel set 14 with respect to the frame 12.

Similarly, the movement of wheel set 16 causes clockwise movement of the bell crank 76B and thereby causes clockwise pivotal movement of the steering lever 52B with respect to the frame 12. This in turn causes relative clockwise pivotal movement of the wheel set 18 with respect to the frame 12.

The linkage as illustrated thus causes pivotal movement of wheel sets 14 and 18 so as to be aligned to the radial configuration. In order to ensure radial alignment the lengths of all of the levers must be chosen with respect to the relationship between the wheel base of the truck (i.e. the distance between wheel sets 14 and 18) and the spacing between pivotal axes 54, 56 and 58. It is expected that those familiar with linkages of this type will have no difficulty in providing the appropriate proportion of the various components.

In order to more fully understand the operation of the truck those familiar with this art will realize that the three axle truck when travelling on curved track assumes the position of a chord. As all three wheel sets must remain on the rails the centrally located wheel set 16 must move with respect to the frame 12 outwardly away from the centre of curvature in order to remain on the track. The amount of lateral movement required by the wheel set 16 in order to stay on the rail of any particular curvature will depend upon the length of the frame establishing the wheel base between wheel sets 14 and 18. The greater the wheel base between the wheel sets 14 and 18 the greater will be the required lateral movement of wheel set 16.

As the frame 12 will essentially be in a chord position when the truck is travelling on curved track the wheel set 16 will be in the radial position if it is perpendicular to the chord and assuming that the chord represented by the frame 12 is equally bi-sected. Thus, as along as wheel set 16 is equidistant from wheel sets 14 and 18 and is maintained perpendicular to the frame 12, then wheel set 16 will also be radial.

It is theoretically possible to locate wheel set 16 other than on the above-described position. However, if the wheel set 16 is other than on the above-described position it too must be rotated about a generally vertical axis with respect to frame 12 to be aligned to the radial configuration.

Figure 2:
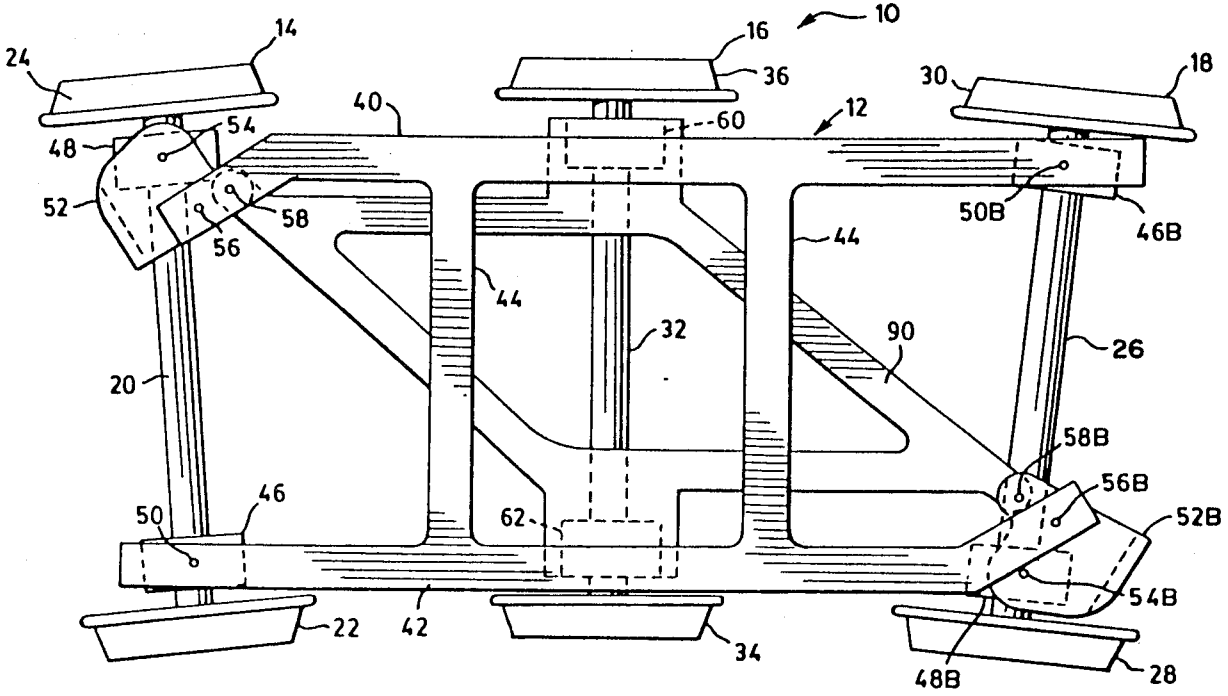
FIG. 2 is similar to FIG. 1, the truck utilizing a second preferred embodiment of the invention.

FIG. 2 illustrates another embodiment of a truck incorporating this invention. Similar parts in the two figures are similarly numbered.

The mechanism illustrated in FIG. 2 replaces the mechanism comprising the guide boxes 70 and 72, the bell cranks 76 and 76B, and the steering rods 74 and 74 by means of a single parallelogram shaped cantilever member 90. Cantilever member 90 is affixed to the axle 32 of wheel set 16 so as to move with wheel set 16 as that wheel set moves laterally with respect to the frame 12 as the truck travels on curved track. The cantilever member 90 is connected to the steering levers 52 and 52B by pivotal connections about the substantially vertical axes 58 and 58B. As will be observed with reference to the diagram, the movement of the cantilever member 90 with respect to the frame 12 causes counterclockwise rotation of the steering lever 52 and clockwise rotation of the steering lever 52B with respect to the frame thereby causing relative pivotal movement of wheel sets 14 and 18 with respect to the frame 12.

The two linkage systems illustrated in FIGS. 1 and 2 each provide an interconnection between the centre wheel set 16 and the two outer wheel sets 14 and 18. In each case the movement of each of the outer wheel sets 14 and 18 is positively controlled by the lateral movement of wheel set 16. It should be observed that the system is stable, as any forces involved in "hunting" of either of wheel sets 14 and 18, which are the only wheel sets capable of such hunting, is restricted by the connection to the wheel set 16. This may be fully appreciated by considering wheel set 14 as illustrated in FIG. 1.

If wheel set 14 attempts to move from the parallel configuration when moving on tangent track it can do so only by causing rotation of the steering lever 52. In order for steering lever 52 to rotate then wheel set 16 must be moved to one side with respect to the frame 12. As the wheel set 16 will be bearing approximately one third of the weight supported by the truck and as its position on the rails is fixed by reason of the conical configuration of wheels 34 and 36, there is substantial force resisting any motion of the wheel set 16. This substantial force is more than sufficient to stabilize the motion of wheel set 14. A similar analysis will show that the wheel set 16 also stabilizes wheel set 18.

It is considered that those familiar with this art will have no difficulty in constructing structures of the type illustrated diagrammatically in FIGS. 1 and 2. An arrangement for constructing the bearings and steering lever of the type illustrated in FIG. 1 is illustrated in detail in Canadian Pat. No. 1,083,886 referred to herein. In the structure illustrated in that patent, bearings are used to provide the various vertical pivotal axes referred to in FIG. 1. An alternate scheme for providing such pivotal movement is illustrated in FIG. 3.

Figure 3:
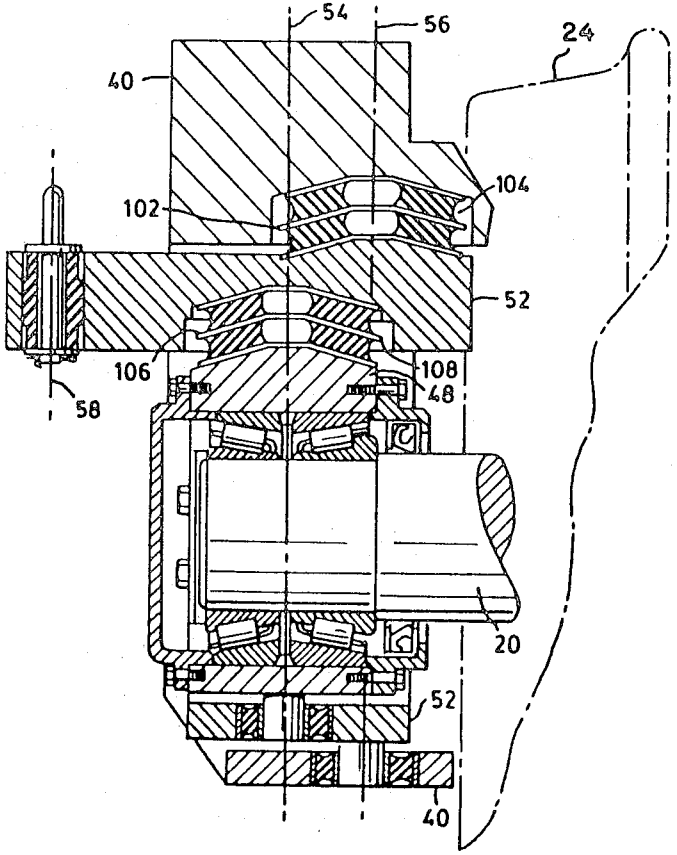
FIG. 3 is a vertical cross-section through a frame axle bearing illustrating a structure for suspending a truck on an axle.

FIG. 3 illustrates in vertical cross-section a mechanism providing for the limited movement required of the steering levers 52. From reviewing FIG. 3 it will become more apparent that the steering lever 52 is an essentially circular collar which surrounds the bearing 48 and the axle 20. The pivotal connection between the steering lever 52 and the frame 40 is identified by the axis numbered 56. Two resilient elastomeric elements 102 and 104 function to pass the weight carried by the frame 40 to the steering lever 52. These elements 102 and 104 are sufficiently strong in the vertical direction to carry the load of the truck but are relatively flexible in shear. The steering lever 52 can pivot with respect to the frame 40 about the axis 56 by loading the elastomeric elements 102 and 104 in shear. With the relatively small arc of pivotal movement required in typical railroad installations this type of mounting is found to be quite acceptable.

The bearing 48 is mounted for pivotal movement about the substantially vertical axis 54 with respect to the steering lever 52. Similar elastomeric members 106 and 108 pass the weight supported by the steering lever 52 to the bearing 48 and thence to the axle 20. The elastomeric elements 106 and 108 are similar to elements 102 and 104. These elements by being loaded in shear allow for sufficient relative pivotal movement between the bearing 48 and the steering lever 52.

FIG. 3 further illustrates a mechanism in which the wheel 24 is mounted inboard of the frame 40, while the mechanism in FIG. 1 illustrates the wheel in an outboard location with respect to the frame 40. The designer is free to use either inboard or outboard mounted wheels, both of which may be used with the mechanism of this invention.

It is considered that those familiar with this form will be well able to devise mechanisms for mounting the third or central axle for movement in the lateral direction while precluding movement in the longitudinal direction. However, various mechanisms are illustrated in FIGS. 4, 5 and 6.

Figure 4:
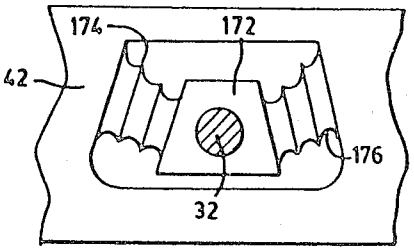
FIG. 4 illustrates a first structure of mounting a third axle to the frame of a truck for relative lateral movement.

FIG. 4 is a simplified cut-away view of one of the bearing means for central axle 32. For the purpose of simplified illustration the bearing 62 and guide box 72 are illustrated as a single member 172. The combination bearing and guide box 172 is supported within the frame member 42 by two elastomeric elements 174 and 176. These elements are relatively stiff in the axial direction thereby precluding any movement of the axle 32 in the longitudinal direction. However, these elements are relatively soft in shear thus allowing motion of the axle 32 either in the vertical direction or in the lateral direction.

Figure 5:
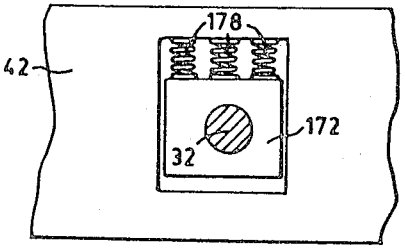
FIG. 5 illustrates an alternate structure of mounting a third axle to the frame of a truck for relative lateral movement.

FIG. 5 is a somewhat similar mounting mechanism embodying coil springs. In this case the combination bearing and guide box 172 is supported within a housing within the frame 42. Coil springs 178 carry the vertical load from the frame 42 to the guide box 172. In this design the guide box 172 may undergo vertical and lateral motions with respect to the frame 42 but no longitudinal motion is permitted.

Figure 6:
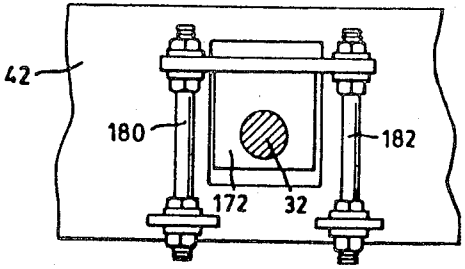
FIG. 6 illustrates a further structure of mounting a third axle to the frame of a truck for relative lateral movement.

FIG. 6 illustrates a mounting system using a pair of swing hangers 180 and 182. In this mounting system the combination bearing and guide box 172 is fitted with a pair of flanges which are attached to the swing hangers 180 and 182 respectively. The swing hanger arrangement is similar to the coil spring arrangement illustrated in FIG. 5 with the exception that the swing hanger prevents vertical motions also, allowing only lateral motion of the axle 32.

These three simplified views illustrate conventional methods used in the railroad arts for mounting an axle to a frame to permit movement in the desired direction while limiting movement in other directions. Those skilled in this art will realize that many other arrangements are possible.

I claim:

1. A three axle truck for use on a railway vehicle comprising:

a frame, first and second axles, a third axle intermediate said first and second axles, said axles having flanged conical wheels attached thereto, all of said axles mounted in bearing means for rotation about respective substantially horizontal axes, steering levers attached to at least one of each of said bearing means of said first and second axle to permit relative pivotal movement between said steering lever and said bearing means about a generally vertical axis, each of said steering levers being attached to said frame for relative pivotal movement between said steering lever and said frame about a generally vertical axis not coincident with the axis between the bearing member and the steering lever, each of said steering levers surrounding said attached bearing and adapted to transfer loads supported from said frame to said bearing, means mounting said bearing means of said third axle to said frame which permit lateral movement of said third axle with respect to said frame, and inhibit pivotal movement with respect to said frame, interconnecting means including linkage means pivotally attached to said steering levers and attached to said third axle, said interconnecting means attached to said steering lever at a location not coincident with the axis of connection between said steering lever and said frame so that lateral movement of said third axle with respect to said frame when said truck travels on curved track results in pivotal movement of said first and second axles with respect to said frame such that said first and second axles move into radial alignment, the pivotal position of said first and second axles at all times being determined by the lateral position of said third axle.

2. The truck of claim 1 wherein said interconnecting means includes separate means interconnecting said first axle to said third axle and separate means interconnecting said second axle to said third axle, at least one of said interconnecting means including a bell crank means pivotally attached to said frame and to said third axle so that lateral movement of said third axle cause pivotal movement of said bell crank means about said pivotal attachment to said frame.

3. The truck of claim 1 wherein said interconnecting means includes a first operative member connected to said third axle for lateral movement therewith and means connected to said first operative member and to said first axle to cause pivotal movement of said first axle upon lateral movement of said first operative member and means connected to said first operative member and to said second axle to cause pivotal movement of said second axle upon lateral movement of said first operative member.

* * * * *